US007052818B2

(12) United States Patent
Marcello et al.

(10) Patent No.: US 7,052,818 B2
(45) Date of Patent: May 30, 2006

(54) TONERS AND PROCESSES THEREOF

(75) Inventors: Vincenzo Marcello, Webster, NY (US); David Kurceba, Hamilton (CA); Nancy Hunt, Webster, NY (US); Cheih-Min Cheng, Rochester, NY (US); Tie Hwee Ng, Mississauga (CA)

(73) Assignee: Xerox Corporation, Stamford, CT (US)

( * ) Notice: Subject to any disclaimer, the term of this patent is extended or adjusted under 35 U.S.C. 154(b) by 30 days.

(21) Appl. No.: 10/744,791

(22) Filed: Dec. 23, 2003

(65) Prior Publication Data

US 2005/0136350 A1 Jun. 23, 2005

(51) Int. Cl.
*G03G 9/00* (2006.01)
*B01F 3/12* (2006.01)

(52) U.S. Cl. ..... 430/137.14; 516/77

(58) Field of Classification Search ..... 430/105, 430/137.14; 516/77
See application file for complete search history.

(56) References Cited

U.S. PATENT DOCUMENTS

| | | | |
|---|---|---|---|
| 4,917,982 | A | 4/1990 | Tomono et al. |
| 4,921,771 | A | 5/1990 | Tomono et al. |
| 4,988,598 | A | 1/1991 | Tomono et al. |
| 4,997,739 | A | 3/1991 | Tomono et al. |
| 5,004,666 | A | 4/1991 | Tomono et al. |
| 5,023,158 | A | 6/1991 | Tomono et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,482,812 | A | 1/1996 | Hopper et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,622,806 | A | 4/1997 | Veregin et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,944 | A | 12/1998 | Foucher et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,922,501 | A | 7/1999 | Cheng et al. |
| 5,925,488 | A | 7/1999 | Patel et al. |
| 5,945,245 | A | 8/1999 | Mychajlowskij et al. |
| 5,977,210 | A | 11/1999 | Patel et al. |
| 6,210,853 | B1 * | 4/2001 | Patel et al. ..... 430/137.14 |
| 6,383,706 | B1 * | 5/2002 | Kumar et al. ..... 430/137.18 |

FOREIGN PATENT DOCUMENTS

| | | |
|---|---|---|
| GB | 1442835 | 4/1990 |

* cited by examiner

*Primary Examiner*—John L Goodrow
(74) *Attorney, Agent, or Firm*—Eugene O. Palazzo; Fay, Sharpe, Fagan, Minnich & McKee, LLP

(57) ABSTRACT

Disclosed is an oil-less toner composition exhibiting good low temperature release and stripping in fixing, enhanced surface gloss of fixed image, and/or OHP transparency. By controlling one or more properties, such as the relative thermal energy input during the EA aggregation/coalescence process, using a wax having a certain dispersion size (D50), molecular weight and/or melting temperature, the toner particle produced thereby can achieve optimal surface wax protrusion with a surface wax content of about 12 to about 25 weight percent. This is based on the total amount of wax in the toner, as determined by x-ray photoelectron spectroscopy (XPS). The contamination of wax on developing rolls, photoreceptor and carriers, which lowers the reliability of the developer, is suppressed with the present exemplary embodiment.

17 Claims, 3 Drawing Sheets

TONERS AND PROCESSES THEREOF

BACKGROUND

There is disclosed herein a method for producing toner compositions containing wax and the resulting toner compositions produced thereby. More particularly, the exemplary embodiment of this disclosure relates to controlling surface wax and wax protrusions in the production of emulsion aggregation (EA) toner compositions. The exemplary embodiments find particular application in conjunction with toner compositions for printing, and will be described with particular reference thereto. However, it is to be appreciated that the present exemplary embodiment is also amenable to other like applications.

Wax may be incorporated in toner particles to improve certain properties such as release or hot offset characteristics of the toner. In toners prepared by the emulsion-aggregation process, there are two approaches for incorporating the wax in toner particles. Wax can be deposited on the surface of the toner particles after they have been formed or wax may be incorporated within the materials that are aggregated together at the outset of the toner formation process. To accomplish the latter, the wax should be in the form of a dispersion of wax in water. Specifically, the wax particles are generally less than a micron in volume average diameter and are suspended in water and stabilized by a dispersant system which is also generally a surfactant (nonionic or ionic) or a surfactant combination (nonionic and ionic or ionic-ionic).

As noted, toner particles may contain wax, either within the interior of the particle or along the particle exterior. Wax, and typically an excessive amount of wax, contaminates developing rolls, photoreceptors, carriers, and other components and surfaces in printing equipment. Accordingly, it would be beneficial to provide a toner composition that exhibited wax characteristics yet avoided the noted contamination problems.

The present exemplary embodiment contemplates a new and improved toner composition which overcomes the above-referenced problems and others.

BRIEF DESCRIPTION

Disclosed herein is a method for producing toner compositions containing wax, and the resulting toner compositions produced thereby. Also disclosed are methods of producing toner particles containing wax, which overcome one or more of the difficulties noted above.

One aspect of the present exemplary embodiment relates to controlling surface wax and wax protrusions in an emulsion aggregation (EA) process for producing toner particles. This is accomplished by controlling one or more parameters, such as thermal energy input, wax dispersion size (D50), the wax molecular weight ($M_w$), and the wax melting point, involved in the toner particle formation process.

A further aspect of the present exemplary embodiment involves the control of the relative thermal energy input during an oil-less aggregation/coalescence process involved in the formation of the toner particles. This energy input varies from about 5,500 cal-min/g to 16,000 cal-min/g, including about 11,000 cal-min/g to about 14,000 cal-min/g.

An additional aspect relates to the control of the dispersion size (D50) of the wax utilized in the process. The wax utilized herein has a wax dispersion size of from about 150 nm to about 350 nm, or from about 170 nm to about 330 nm, or from about 200 nm to about 310 nm.

By controlling the thermal energy input and optionally the wax dispersion size, toner particles are produced exhibiting optimal surface wax and protrusion with a surface wax content of from about 12 to about 25 weight percent, including about 13 to about 23 weight percent, or about 14 to about 20 weight percent. This is based on the total amount of wax in the toner, as determined by x-ray photoelectron spectroscopy (XPS). The contamination of wax on developing rolls, photoreceptor and carriers which would otherwise reduce the reliability of the developer can be suppressed with this aspect, making it possible to provide an oil-less toner exhibiting good low-temperature release and stripping in fixing, enhanced surface gloss of a fixed image, and OHP transparency. A further aspect relates to the toner particles produced by this method.

In a still further aspect, the present exemplary embodiment provides an emulsion aggregation process for producing a toner composition containing wax. The process comprises forming an aqueous dispersion including finely divided resin, colorant, and wax and an optional silica. The process also comprises adding a flocculant or coagulant and heat to the dispersion to form an aggregate system. Additionally, once the desired aggregate size is reached (i.e., from about 2 to about 2.5 microns), the pH of the aggregate system is adjusted to hinder aggregate growth and to form a slurry of the desired sized toner aggregates. The process additionally comprises heating the slurry to a temperature greater than the glass transition temperature (Tg) of the resin (such as from about 70° C. to about 90° C.). And, the process comprises controlling the pH of the slurry to form discrete toner particles. Once the desired toner particle shapes are produced, the temperature is lowered and the particles are optionally washed and dried. During the heating of the aggregate system, the amount of thermal energy input is from about 5,500 cal-min/g to about 16,000 cal-min/g, more particularly from about 8,500 to about 15,000 cal-min/g, or from about 11,000 to about 14,000 cal-min/g. The resulting toner particles produced by this method are also included herein.

In another aspect, the exemplary embodiment provides an emulsion aggregation process for producing toner particles containing a minimum amount of excessive surface or protrusion wax. The process comprises forming a dispersion in water including finely divided polymeric resin, colorant, and wax. One or more dispersants, such as a nonionic, ionic surfactant, or mixtures thereof, can also be included in the dispersions. The process also comprises adding to the dispersion a coagulant, such as a metal halide and heat to form an aggregate system. Additionally, when the aggregates approach the desired size (i.e., from about 2 to about 25 microns in volume average diameter), growth is hindered by adjusting the pH of the aggregate system with a known caustic agent to form a slurry of the desired sized toner aggregates. The process also comprises heating the slurry to a temperature greater than the glass transition temperature (Tg) of the resin (generally about 70° C.). The process further comprises controlling the pH of the slurry (such as by the addition of an acid) to coalesce the aggregates into discrete toner particles. Once the toner particles have the desired shape (such as spherical, potato or raspberry shapes), the toner slurry is cooled to a working temperature, optionally washed to remove surfactants, etc., and dried. During the heating of the aggregate system, the wax is in the form of particles having a volume mean diameter of about 150 nm to about 350 nm. The molecular weight (weighted average) of the wax is about 400 to about 20,000, more particularly, about 400 to about 10,000, or about 400 to about 2,000, and the melting temperature of the wax is about 30° C. to about 180° C., more particularly, about 50° C. to about 130° C. Also disclosed herein are the toner particles produced by this method.

In yet another aspect, the present exemplary embodiment provides an emulsion aggregation process for forming toner particles with an optional amount of surface or protrusion wax. The process comprises forming an aqueous dispersion that includes polymeric resin (such as a shell of latex), colorant or pigment, and polyethylene wax in the form of particles having a mean volume diameter of about 150 nm to about 350 nm, a weight average molecular weight about 400 to about 2,000 and a melting point of about 50° C. to about 130° C. The process also comprises inducing aggregation in the dispersion to form an aggregate system through the addition of a coagulant such as a metal halide followed by heating. In the heating step, the amount of thermal energy input is from about 5,500 cal-min/g to about 16,000 cal-min/g, more particularly, about 11,000 cal-min/g to about 14,000 cal-min/g. When the aggregates approach the desired size (i.e., from about 2 to about 25 microns), growth is hindered by adjusting the pH of the aggregate system with a caustic agent to form a slurry of the desired sized aggregates. The process further comprises heating the slurry to a temperature greater than the glass transition temperature (Tg) of the resin. Additionally, the process comprises adjusting the pH of the slurry with an acid to form toner particles of the desired shapes. The toner particles are then optionally washed and dried. A still further aspect disclosed herein relates to the toner particles produced by this method.

One advantage of the present exemplary embodiment is the reduction or elimination of the wax contamination problems noted above during printing.

Still further advantages and benefits of the present exemplary embodiment will become apparent to those of ordinary skill in the art upon reading and understanding the following detailed description of the preferred embodiments.

BRIEF DESCRIPTION OF THE DRAWINGS

The exemplary embodiment may take form in various components and arrangements of components, and in various steps and arrangements of steps. The drawings are only for purposes of illustrating preferred embodiments and are not to be construed as limiting the exemplary embodiment.

DETAILED DESCRIPTION

Figure 1:
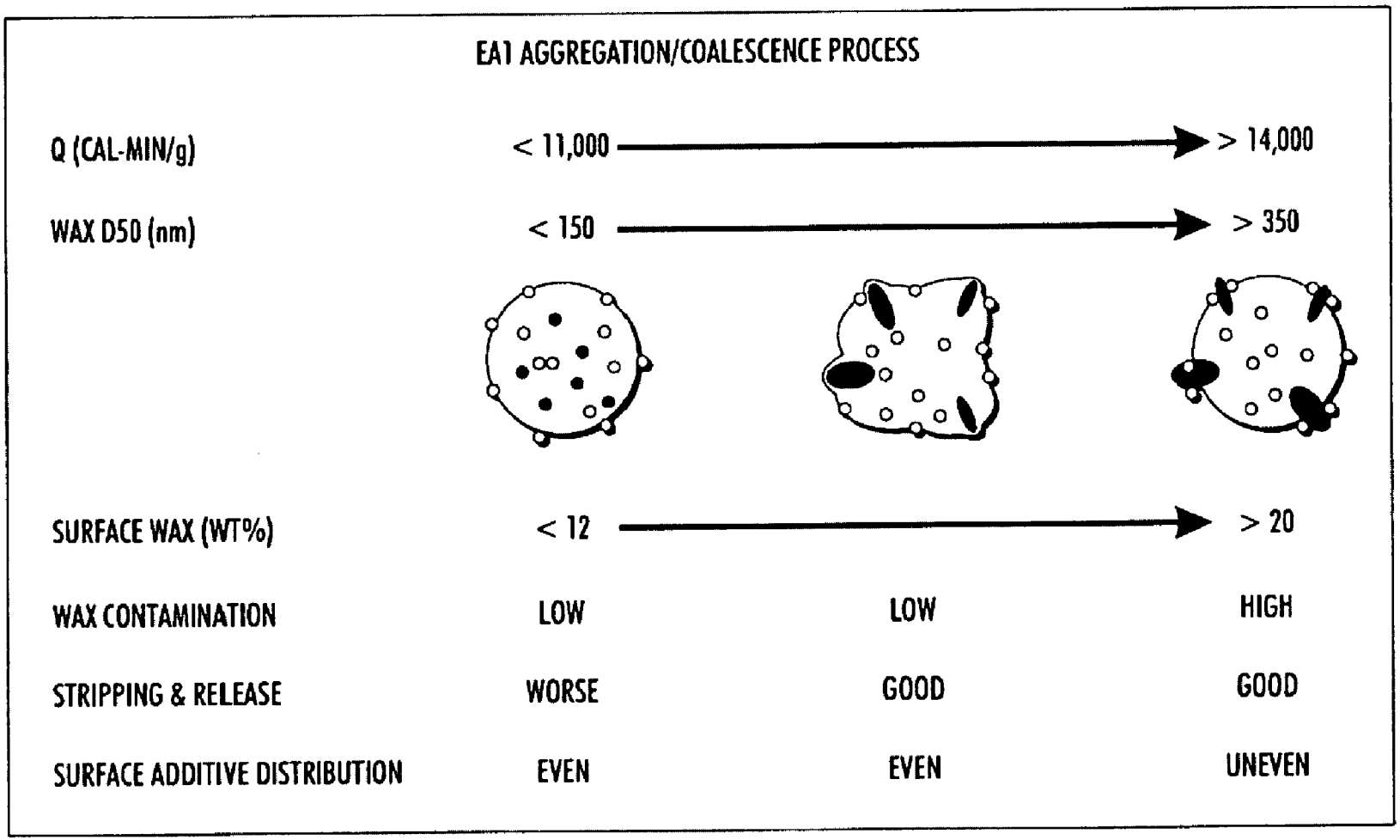
FIG. 1 illustrates the effects of changing the thermal energy input upon wax and performance characteristics of the resulting toner.

Before describing the present exemplary embodiment, it is instructive to consider emulsion aggregation technology. For example, emulsion aggregation coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,482,812; 5,496,676; 5,527,658; 5,585,215; 5,622,806; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,922,501; 5,925,488; 5,945,245; and 5,977,210. The components and processes of the patents can be selected for the present development and embodiments thereof.

The oil-less EA (emulsion aggregation) toner composition is prepared by a process of controlled aggregation of finely divided (i.e., a dispersion size of about 0.01 to about 1.5 microns, more particularly of about 0.05 to about 1.0 microns) and chemically dispersed (i.e., wherein the dispersion is comprised of particles and dispersant, and wherein a dispersant is such as a nonionic, ionic or a mixture of surfactants) toner materials such as latex resin, colorant or pigment, wax, and optionally silica. The process is initially performed by mixing the toner components in water and adding a metal halide coagulant such as polyaluminum chloride (PAC) followed by heating. When the aggregates approach the required size (i.e., from about 2 to about 25 microns in volume average diameter), growth is hindered through adjustment of the pH (i.e., the pH about 4.0 to about 9.0, more particularly the pH about 5.0 to about 6.5) with a known caustic agent (such as sodium hydroxide). The slurry of toner sized aggregates is then heated above the glass transition temperature (Tg) of the resin (typically above about 70° C., preferably above about 80° C., and more preferably about 90° C.), followed by lowering the pH to about 1.5 to about 6.0 (more particularly the pH is lowered from about 2.5 to about 5.5) with an acid to coalesce aggregates into discrete toner particles. Once the toner particles have the desired shape (such as spherical, potato, or raspberry shapes), the toner slurry is cooled to an appropriate working temperature, such as 30° C., more particularly, the temperature is about 10° C. to about 50° C. The resulting particles are then washed to remove impurities, surfactants, etc., and dried.

The resin selected for the process of the present exemplary embodiment is preferably prepared by emulsion polymerization methods. The monomers utilized in such processes include styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinum chloride, and the like. The presence of acid or basic group is optional, and such groups can be present in various amounts of from about 0.1 to about 10 percent by weight of the polymer resin. Known chain transfer agents, for example dodecanethiol, about 1 to about 10 percent, water soluble thiols such as butanethiol, propanethiol or carbon tetrabromide in effective amounts, such as from about 1 to about 10 percent, can also be selected when preparing the resin particles by emulsion polymerization.

The resins selected, which generally can be in embodiments styrene acrylates, styrene butadienes, styrene methacrylates, or polyesters, are present in various effective amounts, such as from about 85 weight percent to about 98 weight percent of the toner, and can be of small average particle size, such as from about 0.001 micron to about 1 micron in average volume diameter as measured by the Brookhaven nanosize particle analyzer. Other sizes and effective amounts of resin particles may be selected in embodiments, for example copolymers of poly(styrene butylacrylate acrylic acid) or poly(styrene butadiene acrylic acid).

Various known colorants or pigments present in the toner composition in an effective amount of, for example, from about 1 to about 25 percent by weight of the toner, and preferably in an amount of from about 1 to about 15 weight percent, can be selected such as for example carbon black and magnetites. As colored pigments, there can be selected cyan, magenta, yellow, red, green, brown, blue or mixtures thereof.

The toner composition may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrate a toner with a distearyl dimethyl ammonium methyl sulfate charge additive, the disclosures of which are totally incorporated herein by reference, negative charge enhancing additives like aluminum complexes, and the like. Surfactants in amounts of, for example, about 0.1 to about 25 weight percent in embodiments include, for example, nonionic surfactants such as dialkylphenoxypoly(ethyleneoxy) ethanol. An effective concentration of the nonionic surfactant is in embodiments, for example from about 0.01 to about 10 percent by weight, and preferably from about 0.1 to about 5 percent by weight of monomers, used to prepare the copolymer resin.

Examples of ionic surfactants include anionic and cationic with examples of anionic surfactants being, for example, sodium dodecylsulfate (SDS), sodium dodecylbenzene sulfonate, sodium dodecylnaphtalene sulfate, dialkyl benzenealkyl, sulfates and sulfonates, abitic acid. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend.

Examples of the cationic surfactants, which are usually positively charged, selected for the toners and processes of the present disclosure include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, C12, C15, C17 trimethyl ammonium bromides, halide salts of quaternized polyoxyethylakylamines, dodecylbenzyl triethyl ammonium chloride, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to about 4, and preferably from about 0.5 to about 2.

Counterionic surfactants are comprised of either anionic or cationic surfactants as illustrated herein and in the amount indicated. When an ionic surfactant is referenced as an anionic surfactant, the counterionic surfactant is a cationic surfactant, and vice-versa.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent. Additional details are described in U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation process or blended into the formed toner product.

In accordance with the exemplary embodiment, the EA oil-less toner design uses a wide variety of commercially available waxes to impact the release properties desire by the particles in the fuser. Examples of waxes are known, and include, for example, alkylenes, such as polypropylene, polyethylene, reference U.S. Pat. Nos. 5,023,158; 5,004,666; 4,997,739; 4,988,598; 4,921,771; and, 4,917,982; and U.K. Patent No. 1,442,835, the disclosures of which are totally incorporated herein by reference, and the like. Many of the waxes selected are hydrophobic and essentially water insoluble. Specific examples of waxes are: (1) natural waxes such as those preferably extracted from vegetables (Carnauba wax, Japan wax, Bayberry wax) or animals (Beeswax, Shellac wax, Spermaceti wax); (2) mineral waxes, such as those preferably extracted, for example, from bituminous lignite or share (Montan wax, Ozokerite wax, Ceresin wax); (3) petroleum waxes, complex mixtures of paraffinic hydrocarbons obtained from the distillation of crude petroleum (Paraffin wax), or by dewaxing heavy lubricating oils and petrolatum residues (microcrystalline wax); and (4) synthetic waxes generated, for example, by chemical processes including petroleum, Fischer-Tropsch (by coal gasification), polyethylene, polypropylene, acrylate, fatty acid amides, silicone and polytetrafluoroethylene waxes. Of these, the petroleum, polyethylene, polypropylene and silicone waxes are preferred for incorporation into the polymer shell latex. Examples of specific waxes include those as illustrated herein and are available from Allied Chemical and Petrolite Corporation, and examples of wax emulsions include those as illustrated herein which are available from Michaelman Inc, Petrolite Company, the Daniels Products Company, and the Genesee Polymers Corporation, wherein the wax emulsions are prepared dispersions of a wax in water, which dispersion is comprised of a wax, and a dispersant such as a nonionic, ionic or a mixture of surfactants. The wax is preferably a polyethylene, a polypropylene, or a silicone wax. The polyethylene waxes have a weight average molecular weight $M_w$ of from about 400 to about 2,000, a number average molecular weight Mn of from about 300 to about 1,500, and a melting temperature (Tm) of from about 50° C. to about 130° C. The polypropylene waxes have an $M_w$ of from about 1,000 to about 10,000, an Mn of from about 500 to about 8,000, and a melting temperature of from about 120° C. to about 180° C. The silicone waxes have an $M_w$ of from about 5,000 to about 20,000, an Mn of from about 2,000 to about 15,000, and a melting temperature of from about 30° C. to about 90° C.

When the surface wax or extent of wax protrusions on the surface of toner particles is limited, occurrence of a low-temperature offset at fixing and increase in stripping force associated thereto are liable to occur. For toners with excess surface wax or a high degree of wax protrusion, contamination of the developer system will occur. Although the toner particles with excess surface wax are advantageous in terms of release in the fixing process and cleaning of the un-transferred toner from the photoreceptor, it is likely that a mechanical force, such as the shearing force inside the developing apparatus, causes the wax to separate from the toner particles. The wax then migrates to the developing roll, the photoreceptor and carrier. Consequently, the contamination of these members within the system lowers the reliability of the developer. It is desired to obtain optimal surface wax content and extent of wax protrusion on the toner particle surface for oil-less emulsion aggregation toner applications.

In one aspect, the present exemplary embodiment is directed to controlling the relative thermal energy input during the oil-less aggregation/coalescence process from about 5,500 to about 16,000 cal-min/g, more particularly, from about 11,000 to about 14,000 cal-min/g, and using a wax dispersion size (D50) of about 150 to about 350 nm, more particularly, from about 170 to about 330 nm, and even more particularly, from about 200 to about 310 nm. The exemplary embodiment includes processes in accordance with each of these aspects independently of each other, and particularly, these aspects in combination with each another. The resulting toner particles achieve optimal surface wax protrusion with a surface wax content of about 12 to about 25 weight percent (preferably, about 13 to about 23 weight percent, more preferably, about 14 to about 20 weight percent). This is based on the total amount of wax in the toner, as determined by x-ray photoelectron spectroscopy (XPS). This control of the relative thermal energy input resolves contamination issues caused by migration of wax in the system that would ultimately lower the reliability of the developer. Thus, the present exemplary embodiment provides for an oil-less toner which exhibits good low-temperature release and stripping in fixing, surface gloss of fixed image, and OHP (overhead projector) transparency.

Further optional results are also obtained through the use of the waxes set forth above, with the polyethylene, polypropylene and silicone waxes being the more preferred. The disclosed weighted average molecule weight, number average molecular weight and the melting point ranges of these waxes are set forth above.

FIG. 1 illustrates the effects upon various characteristics of the toner particles by varying the amount of thermal energy during their formation.

Figure 2:
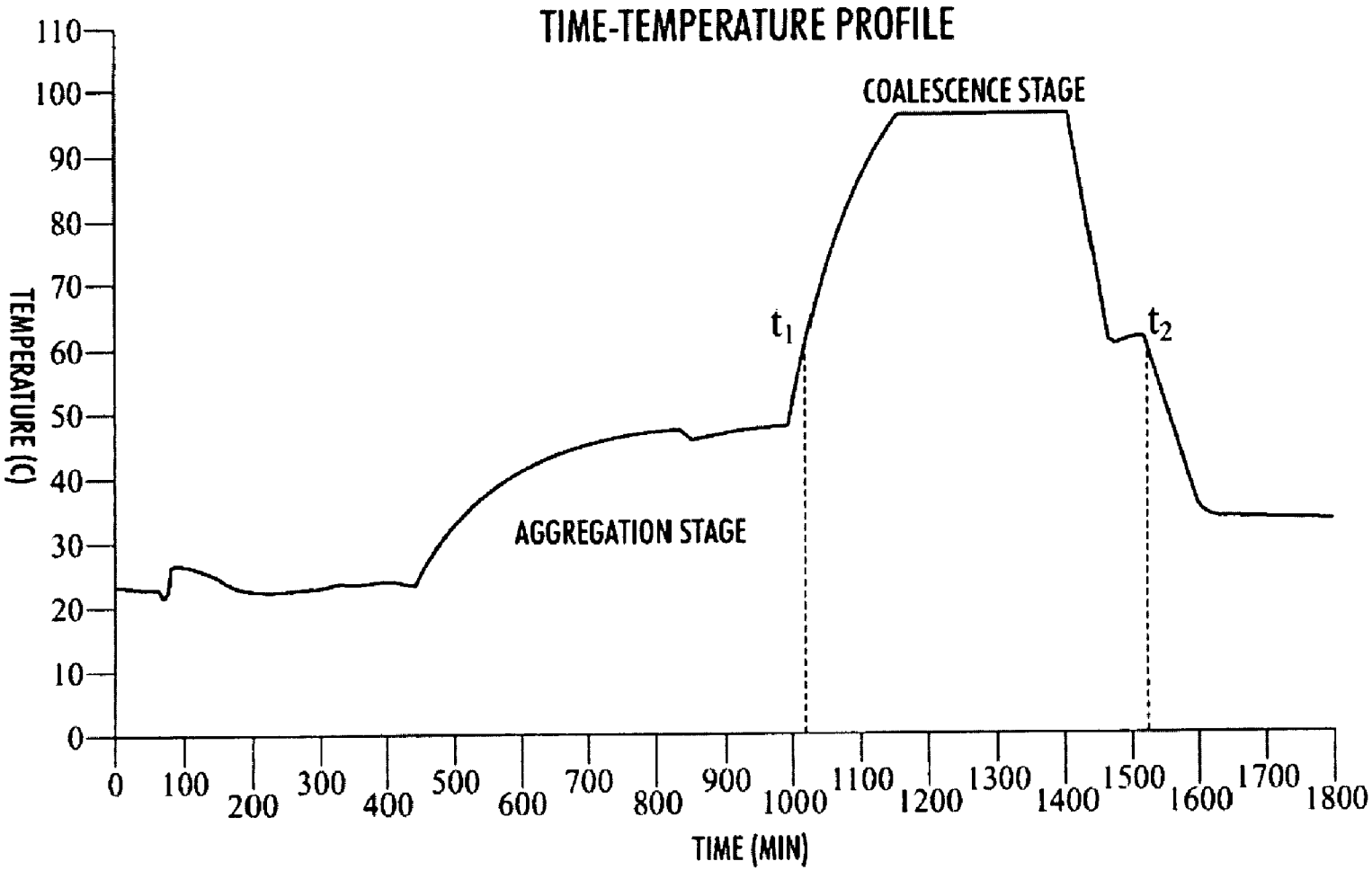
FIG. 2 is a time-temperature profile for an oil-less aggregation/coalescence reaction.

The cause of the surface wax and wax protrusion phenomena is wax within the toner particle becoming molten during the coalescence process when the reaction temperature is higher than the temperature at which the wax starts to melt. In one example, the EA oil-less toner design uses polyethylene wax Polywax 725® available from Baker-Petrolite to impart the release properties desired of the particles in the fuser. Polywax 725 ® has a molecular weight of about 730 and a melting point of about 98° C. A DSC plot shows that the Polywax P725 ® starts to melt at a temperature of about 6020 C. As noted, the present exemplary embodiment proposes that the surface wax and wax protrusion can be controlled by the relative thermal energy input Q in the EA aggregation/coalescence process. As shown in the EA aggregation/coalescence time-temperature profile in FIG. 2, the relative thermal energy input Q can be estimated based on the below equation:

$$Q = \int_{t1}^{t2} Cp(T - To)dt$$

In this equation, T is the coalescence temperature, To (To =temperature where wax starts to melt) is 60° C. for Polywax 725®, t1 is the time when coalescence temperature reaches 60° C., t2 is the time when the reaction starts to cool down below 60° C., and Cp is the heat capacity of the reaction mixture. In accordance with the present exemplary embodiment, the relative thermal energy input Q is in the range of about 5,500 to about 16,000 cal-min/g. If the thermal energy input Q is less than about 5,500 cal-min/g, the surface wax or wax protrusion on toner particle surface is limited or non-existent. At this point when the surface wax content is less than 12 weight percent of the total wax in the toner particles, occurrence of a low-temperature offset at fixing and increase in stripping force associated thereto are liable to occur. And if the thermal energy input Q exceeds about 16,000 cal-min/g, the amount of wax on the toner particle surface increases, ultimately achieving 25 weight percent. Thus, a shearing force inside the developing apparatus causes the wax to separate from the toner particle, which migrates easily to such members as the developing roll, a photoreceptor and carrier. Consequently, the contamination of these members lowers the reliability of the developer. Severe wax protrusion also causes non-uniform distribution of surface additives on the toner particles and leads to poor transfer efficiency and filming.

The volume mean diameter (D50) of the wax particles, in the wax dispersion obtained, is measured by a laser diffraction type particle size distribution measurement apparatus (Microtrac). In accordance with the exemplary embodiment, the volume mean diameter (D50) of the wax particles is in the range of about 150 to about 350 nm. If the volume mean diameter (D50) is less than about 150 nm, the necessary amount of the releasing agent at fixing undesirably increases. If the volume mean diameter (D50) exceeds about 350 nm, the aggregation is prone to become unstable, and the amount of wax on the toner particle surface increases. A shearing force inside the developing apparatus causes the wax to separate from the toner particles and to migrate easily to such members as the developing roll, photoreceptor and carrier. Consequently, the contamination of these members lowers the reliability of the developer.

Figure 3:
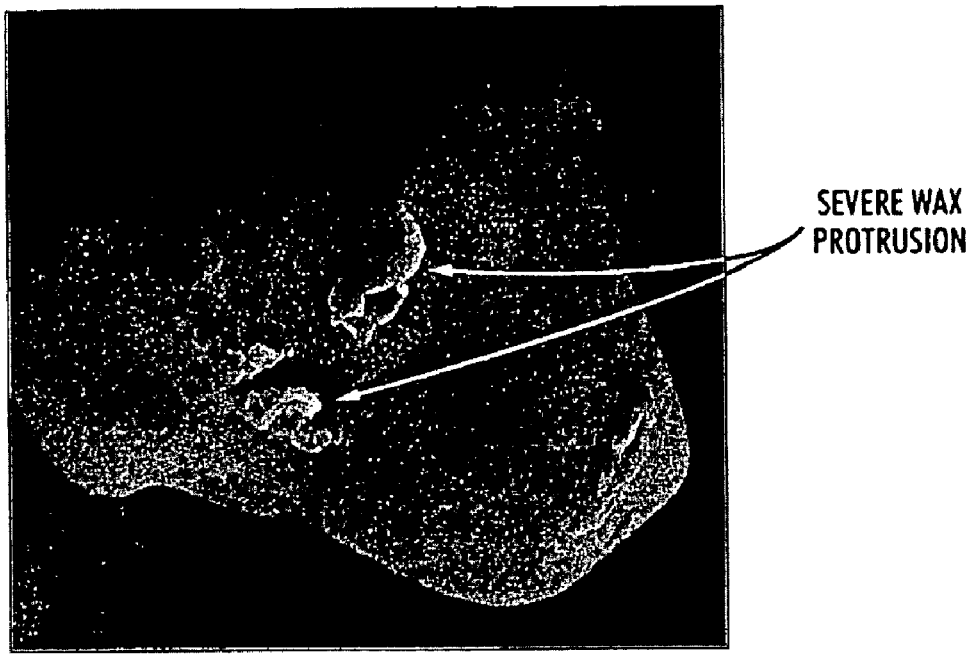
FIG. 3 is a micrograph of an emulsion aggregation toner particle containing Polywax 725 wax of particle size of 404 nm, formed under a relative thermal energy input of 16,340 cal-min/g in an aggregation/coalescence process. The resulting toner contains 26 weight percent of surface wax. Severe surface wax protrusions are evident.
Figure 4:
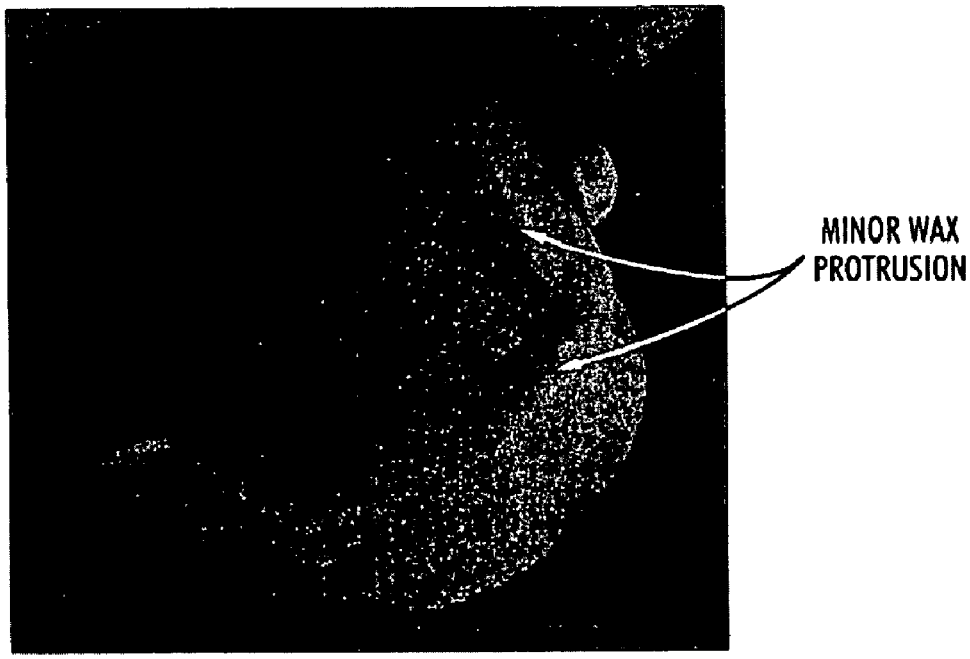
FIG. 4 is a micrograph of an emulsion aggregation toner particle containing Polywax 725 wax of particle size of 269 nm, formed under a relative thermal energy input of 13,480 cal-min/g in an aggregation/coalescence process. The resulting toner contains 16 weight percent of surface wax. The surface wax protrusions are minor.

FIGS. 3 and 4 show the dramatic effect of the thermal energy input on surface wax and wax protrusion.

Emulsion aggregation toner with controlled surface wax and wax protrusion for EA toner applications was produced. Table 1 shows the fusing and stripping evaluations of the resulting oil-less emulsion aggregation toner particles.

TABLE 1

Fusing & Stripping Evaluations of Toners

| Toner ID | Design Target | Cyan C4 | Magenta M3 | Magenta M4 | Yellow Y3 | Yellow Y4 |
|---|---|---|---|---|---|---|
| Aggregation/Coalescence Thermal Energy Input Q (cal-min/g) | 11,000–14,000 | 13480 | 13120 | 13320 | 13410 | 13590 |

TABLE 1-continued

Fusing & Stripping Evaluations of Toners

| Toner ID | Design Target | Cyan C4 | Magenta M3 | Magenta M4 | Yellow Y3 | Yellow Y4 |
|---|---|---|---|---|---|---|
| Wax Particle Size D50 (nm) | 150–350 | 269 | 276 | 283 | 278 | 272 |
| Surface Wax Content (wt % of total wax) | 12–20 | 16.3 | 14.5 | 17.6 | 17.2 | 16.2 |
| MFT 80 Crease (° C.) | Color ≦148 | 130 | 134 | 135 | 120 | 124 |
| COT (° C.) | Color ≦120 | <120 | 120 | <120 | <120 | <120 |
| HOT (° C.) | ≧200 | >200 | >200 | >200 | >200 | >200 |
| Stripping Force (gf)[1] | ≦25 | 11.4 | 7.3 | 9.4 | 10.5 | 7.6 |
| Gloss (ggu)[2] | Color ≧35 | 39 | 41 | 45 | 42 | 40 |
| Project Efficiency (%)[3] | ≧60 | 78 | 63 | 63 | 64 | 66 |

Note
[1]Stripping Force Evaluation:
Equipment: Stripping Force Fixture
Paper: Fuji Xerox S paper
TMA: 1.35 mg/cm$^2$
Note
[2]Crease MFT & Gloss Evaluation:
Fuser: Imari-MF free belt nip fuser, Spode process speed
Paper: Xerox 4024
TMA: Crease, HOT & Cot 1.03 mg/cm$^2$; Gloss 0.43 mg/cm$^2$
Note
[3]Projection Efficiency Evaluation:
Equipment: MatchScan-II
Fuser: Imari-MF free belt nip fuser, Spode process speed
Transparency: Xerox 3R3108
TMA: 0.43 mg/cm$^2$ It is shown that by controlling the relative thermal energy input during an oil-less aggregation/coalescence process from about 5,500 to about 16,000 cal-min/g, and more particularly, from about 11,000 to about 14,000 cal-min/g, and using a wax dispersion size (D50) of about 150 to about 350 nm, more particularly, about 170 nm to about 330 nm, or about 200 to about 310, the resulting toner particles exhibit optimal surface wax protrusion with a surface wax content of about 12 to about 25 weight percent, more particularly, about 13 to about 23 weight percent, and even more particularly, about 14 to about 20 weight percent. This is based on the total amount of wax in the toner. This control of the relative thermal energy input resolves contamination issues caused by migration of wax in the system that would ultimately lower the reliability of the developer. Thus, the present exemplary embodiment provides for an oil-less toner excellent in low-temperature release and stripping in fixing, in surface gloss of fixed image, and OHP transparency. Toners with controlled surface wax and wax protrusion also demonstrate excellent transfer efficiency stability.

Additionally, further beneficial results have been obtained with waxes having an average molecular weight of about 400 to about 20,000, more particularly, about 400 to about 10,000, and even more particularly, about 400 to about 2,000, and a melting temperature of about 30° C. to about 180° C., more particularly, about 50° C. to about 130° C.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An emulsion aggregation process for producing toner particles containing wax, said process comprising:

forming an aqueous dispersion including finely divided resin, colorant, and wax;

adding a coagulant and heat to the dispersion to form an aggregate system;

adjusting the pH of said aggregate system to form a slurry of the desired sized toner aggregates;

heating said slurry to a temperature greater than the glass transition temperature (Tg) of said resin; and controlling the pH of said slurry to form discrete toner particles;

wherein during said heating of said aggregate system, the amount of thermal energy input is from about 5,500 cal-min/g to about 16,000 cal-min/g.

2. The process of claim 1, wherein said wax is in the form of particles having a volume mean diameter of about 150 nm to about 350 nm.

3. The process of claim 2, wherein said wax has a melting temperature of about 30° C. to about 180° C.

4. The process of claim 1, further comprising:

after formation of said toner particles, washing said toner particles; and drying said toner particles.

5. The process of claim 1, wherein said wax is a polyethylene wax.

6. The process of claim 5, wherein said polyethylene wax has a weight average molecular weight of about 400 to about 20,000.

7. The process of claim 5, wherein said polyethylene wax has a melting point of about 5000 to about 130° C.

8. An emulsion aggregation process for producing toner particles containing an effective amount of surface and protrusion wax for printing, said process comprising:

forming a dispersion in water including finely divided polymeric resin, colorant, and wax;

adding a coagulant and heat to the dispersion to form an aggregate system;

adjusting the pH of said aggregate system to form a slurry of the desired sized toner aggregates;

heating said slurry to a temperature greater than the glass transition temperature (Tg) of said resin; and, controlling the pH of said slurry to form discrete toner particles of a desired shape;

wherein during said heating of said aggregate system, the amount of thermal energy input is from about 5,500 cal-min/g to about 16,000 cal-min/g and said wax is in the form of particles having a mean volume diameter of about 150 nm to about 350 nm.

9. The process of claim 8, wherein during heating of said aggregate system, the amount of thermal energy input is from about 5,500 cal-min/g to about 14,000 cal-min/g.

10. The process of claim 9, wherein said wax has a melting temperature of about 30° C. to about 180° C.

11. The process of claim 8, further comprising: after formation of said toner particles, washing said toner particles; and drying said toner particles.

12. The process of claim 8, wherein said wax is a polyethylene wax.

13. The process of claim 12, wherein said polyethylene wax has a molecular weight of about 400 to about 2,000.

14. The process of claim 12, wherein said polyethylene wax has a melting point of about 50° C. to about 130° C.

15. An emulsion aggregation process for forming toner particles including wax, said process comprising:

forming an aqueous dispersion that includes polymeric resin, colorant, and a polyethylene wax in the form of particles having a mean volume diameter of about 150 nm to about 350 nm;

inducing aggregation in said dispersion to form an aggregate system;

heating said aggregate system wherein the amount of thermal energy input is from about 5,500 cal-min/g to about 16,000 cal-min/g;

adjusting the pH of said aggregate system to form a slurry of the desired sized toner aggregates;

heating said slurry to a temperature greater than the glass transition temperature (Tg) of said resin; and adjusting the pH of said slurry to form discrete toner particles of the desired shape.

16. The process of claim 15, further comprising:

after formation of said toner particles, washing said toner particles; and drying said toner particles.

17. The process of claim 15, wherein said polyethylene wax has an average molecular weight of about 400 to about 2,000 and a melting point of about 50° C. to about 130° C.

* * * * *